US007269269B2

(12) United States Patent
Hamacher et al.

(10) Patent No.: US 7,269,269 B2
(45) Date of Patent: Sep. 11, 2007

(54) METHOD TO ADJUST AN AUDITORY SYSTEM AND CORRESPONDING AUDITORY SYSTEM

(75) Inventors: Volkmar Hamacher, Neunkirchen am Brand (DE); Matthias Wesselkamp, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 755 days.

(21) Appl. No.: 10/789,832

(22) Filed: Feb. 27, 2004

(65) Prior Publication Data

US 2004/0213424 A1 Oct. 28, 2004

(30) Foreign Application Priority Data

Feb. 27, 2003 (DE) ..... 103 08 656

(51) Int. Cl.
*H04R 25/00* (2006.01)

(52) U.S. Cl. ..... 381/314; 381/315

(58) Field of Classification Search ..... 381/314, 381/315

See application file for complete search history.

(56) References Cited

U.S. PATENT DOCUMENTS 4,972,487 A * 11/1990 Mangold et al. ..... 381/315
5,303,306 A * 4/1994 Brillhart et al. ..... 381/315
5,610,988 A * 3/1997 Miyahara ..... 381/312
2002/0037087 A1* 3/2002 Allegro et al. ..... 381/312

FOREIGN PATENT DOCUMENTS

| | | | |
|---|---|---|---|
| DE | 44 27 044 | A1 | 2/1996 |
| DE | 198 15 373 | A1 | 10/1999 |
| EP | 0 341 997 | B1 | 11/1989 |
| WO | WO99/19779 | A1 | 4/1999 |
| WO | WO 01/52597 | A1 | 7/2001 |

* cited by examiner

*Primary Examiner*—Daniel Swerdlow
(74) *Attorney, Agent, or Firm*—Schiff Hardin LLP

(57) ABSTRACT

An adjustment of hearing device systems is achieved by an interactive adaptation that is undertaken during the operation. A classifier recognizes various auditory situations and starts interactive adaptation procedures, in the framework of which various settings are to be evaluated. Only settings that fit the auditory situation are thereby offered. As a result of the evaluations, an optimal hearing aid settings results for the respective auditory situation.

14 Claims, 3 Drawing Sheets

METHOD TO ADJUST AN AUDITORY SYSTEM AND CORRESPONDING AUDITORY SYSTEM

BACKGROUND OF THE INVENTION

The present invention concerns a method to adjust an auditory system that comprises at least one hearing aid, whereby a plurality of setting configurations are provided in the auditory system. Moreover, the present invention concerns a corresponding auditory system with at least one hearing aid.

If a person hard of hearing obtains a hearing aid (for example, a hearing device, a middle ear implant, or a cochlea implant), it is individually adapted to him. This ensues in a first step via an initial adaptation that is normally implemented by a hearing device acoustician. In a plurality of subsequent sessions at the hearing device acoustician, the hearing device is optimized little by little in its adjustment such that it meets the individual requirements of the hearing device user. Since the attempts by a hearing device acoustician normally involve expense, in many cases this fine tuning is avoided and necessary fine adjustments are no longer implemented.

In this context, a hearing aid is known from International patent publication no. WO 99/19779 A1 with a fuzzy logic system and a neural net that must be trained. A programmable hearing device can be adapted with an auxiliary device via an interactive procedure. However, no adaptations to everyday situations occur that are specific to the hearing device user.

Furthermore, hearing devices are known from the published German patent publication DE 198 15 373 A1 and European patent publication EP 0 341 997 B1 in which modification data sets are hard coded which are activated in special situations relative to a base setting. This reference discloses how the known data sets for various auditory programs and situations are physically stored given the adaptation in the hearing device.

SUMMARY OF THE INVENTION

The object of the present invention is to provide a different mechanism of an adaptation for the hearing device user.

This object is inventively achieved via a method to adjust an auditory system that comprises at least one hearing aid, with the steps: provide a plurality of setting configurations in the auditory system; automatic classification of a current auditory situations; offer a group of setting configurations from the plurality of setting configurations, dependent on the classified auditory situation; and interactive selection with the auditory system of a setting configuration from the group of setting configurations.

Moreover, an auditory system is inventively provided with at least one hearing aid and a storage device to provide a plurality of setting configurations; a classification device to automatically classify an auditory situation; a calculation device to automatically select a group of setting configurations from the plurality of setting configurations, dependent on the classified auditory situation; and an input device for interactive selection of a setting configuration from the group of setting configurations.

With this, a fine adjustment of a hearing aid, optimized for the relevant situations of the hearing device user, is enabled without the assistance of a specialist. The hearing device user also does not have to possess any knowledge at all about the auditory system. The adaptation ensues merely in that the preferred settings are selected.

According to the various embodiments of the invention described as follows, the interactive selection can ensue with one or more operating elements on the hearing aid. Given a comfortable design of an embodiment of the auditory system, the interactive selection may ensue with the aid of a remote control. In the broadest sense, a mobile telephone (that, for example, communicates with the hearing aid via a Bluetooth interface) also counts as such a remote control. A likewise comfortable variant is that the interactive selection ensues via speech input via a corresponding speech input unit.

All of the method steps can be implemented in and/or on the at least one hearing aid. This applies when all devices (namely the storage device, the classification device, the calculation device and the input device) are integrated into the at least one hearing aid of the inventive system. No additional external devices are required in order to interactively adjust the hearing aid. However, in principle the setting event can also be implemented with the aid of external systems. Such external systems can also be provided for the input of data in order to, for example, swap out computer intelligence. This can in particular be the case for what are known as in-the-ear hearing devices or implants that, due to shortage of space, cannot, for example, possess a large storage device for setting configurations and a calculation device for automatic selection of a group of setting configurations.

The group of setting configurations is preferably determined via a simplex method. Simplex methods are known as optimization methods for "interactive fittings" (IAF). They are based on a systematic algorithm and automatically converge on an optimal setting.

The setting configurations can be designed for binaural auditory systems. The setting of each of the two hearing aids can ensue individually, or the corresponding data can be wirelessly exchanged between the hearing aids when the interactive adjustments ensue via a hearing aid that serves as a "master".

DESCRIPTION OF THE DRAWING

The present invention is now explained in detail using the attached drawings.

DETAILED DESCRIPTION OF THE PREFERRED EMBODIMENTS

The subsequently specified exemplary embodiments represent preferred embodiments of the present invention with regard to a hearing device. However, the invention is also applicable to other hearing aids.

Figure 1:
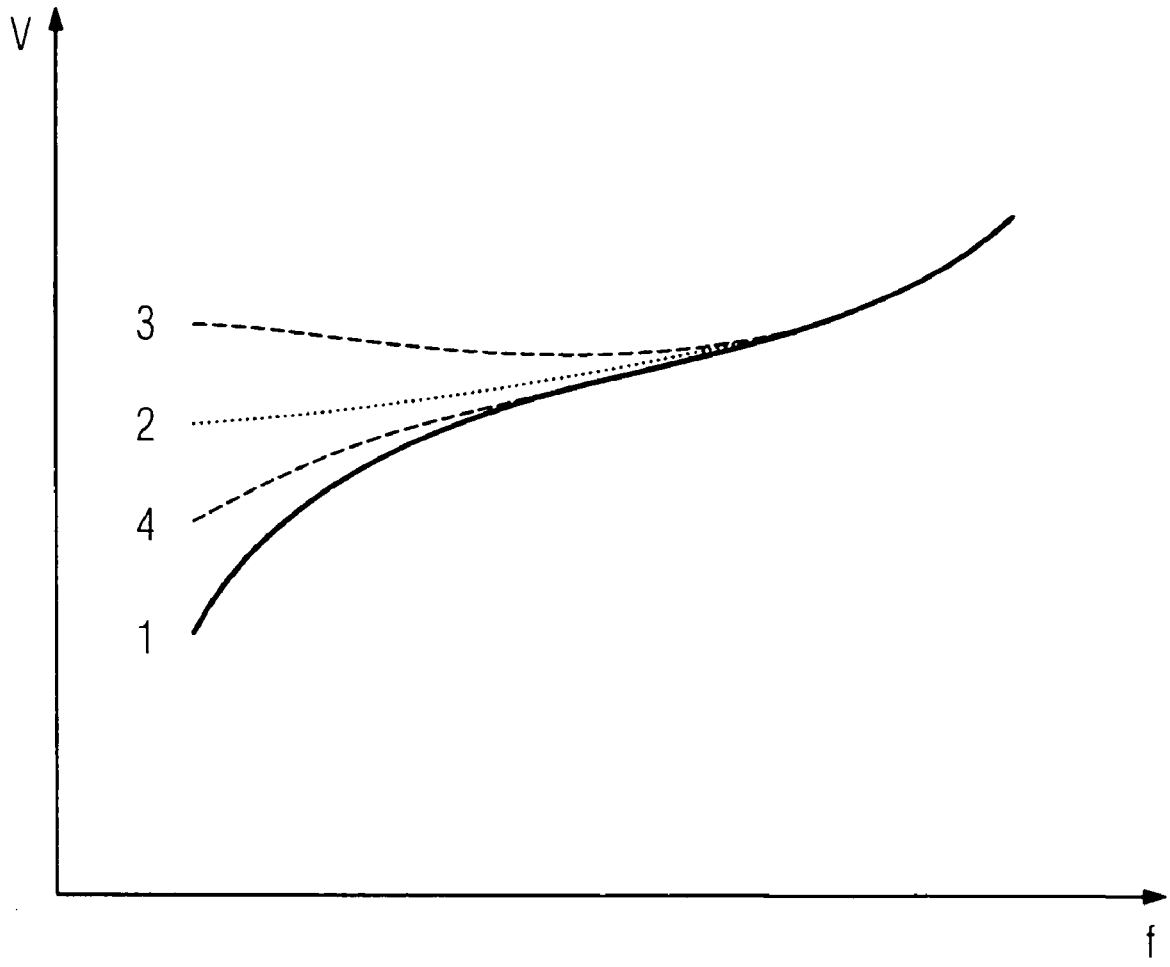
FIG. 1 is a graph showing the setting event using characteristic curves.

The inventive setting event can be understood in principle with the aid of FIG. 1. The hearing device user establishes that his hearing device should be readjusted (for example, when listening to music). This music situation is correspondingly classified, and the auditory system determines from this that only very specific parameters must be changed. The parameters to be changed concern, for example, the low-frequency range of an amplification characteristic curve.

The current amplification characteristic curve 1 over the frequency f is symbolized in FIG. 1 with the solid line. The optimal characteristic curve 2 (i.e., the most suitable for the hearing device user) is shown as a dotted curve in FIG. 1.

After the hearing device user has determined that the current characteristic curve 1 is not optimal for him in this situation, he initiates the adaptation process, such that a first new characteristic curve 3 is offered to him after the classification. The hearing device user likewise rates this as non-optimal, since it exhibits too-high of an amplification in the low-frequency range. The auditory system thereupon offers a second new characteristic curve 4 that is below the first new characteristic curve 3 but above the original characteristic curve 1. When the hearing device user also feels that this second new characteristic curve 4 is also not optimal, the auditory system again always outputs new characteristic curves until the optimal characteristic curve 2 is found. A systematic algorithm sees to it that the input characteristic curves converge with the optimal characteristic curve 2.

Two known algorithmic approaches are utilized in the technical realization:

a) automatic situation recognition, and b) interactive adaptation methods.

Both algorithms can be integrated into the auditory system or, respectively, run completely or in part on an external system.

Figure 2:
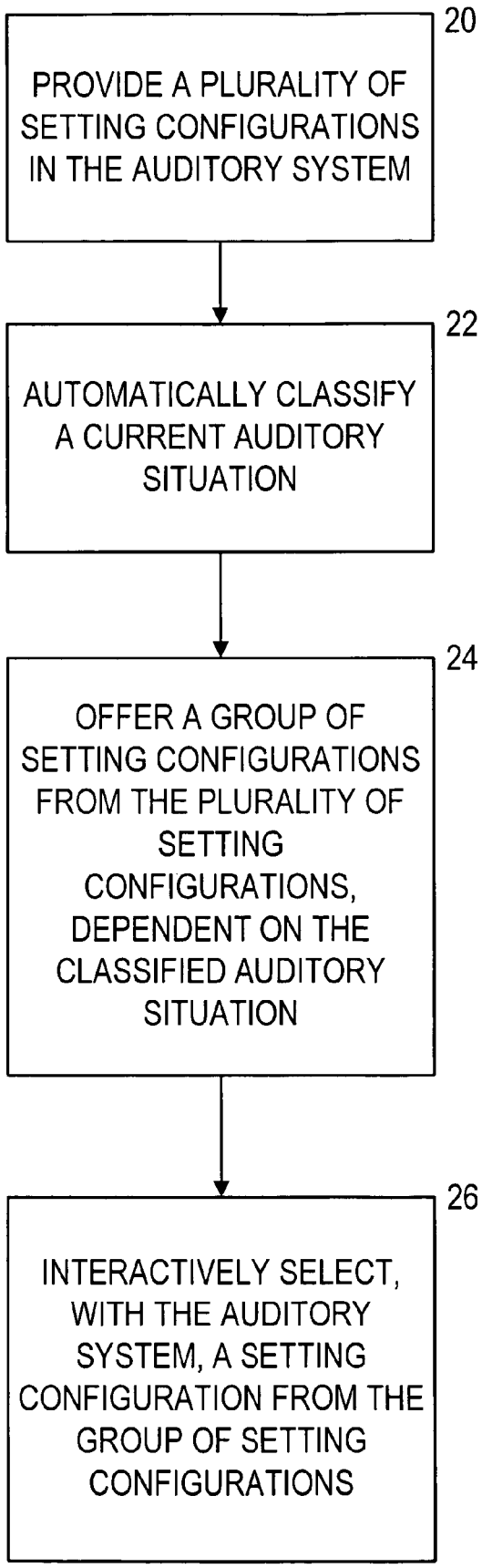
FIG. 2 is a block diagram showing an embodiment of the inventive method.
Figure 3:
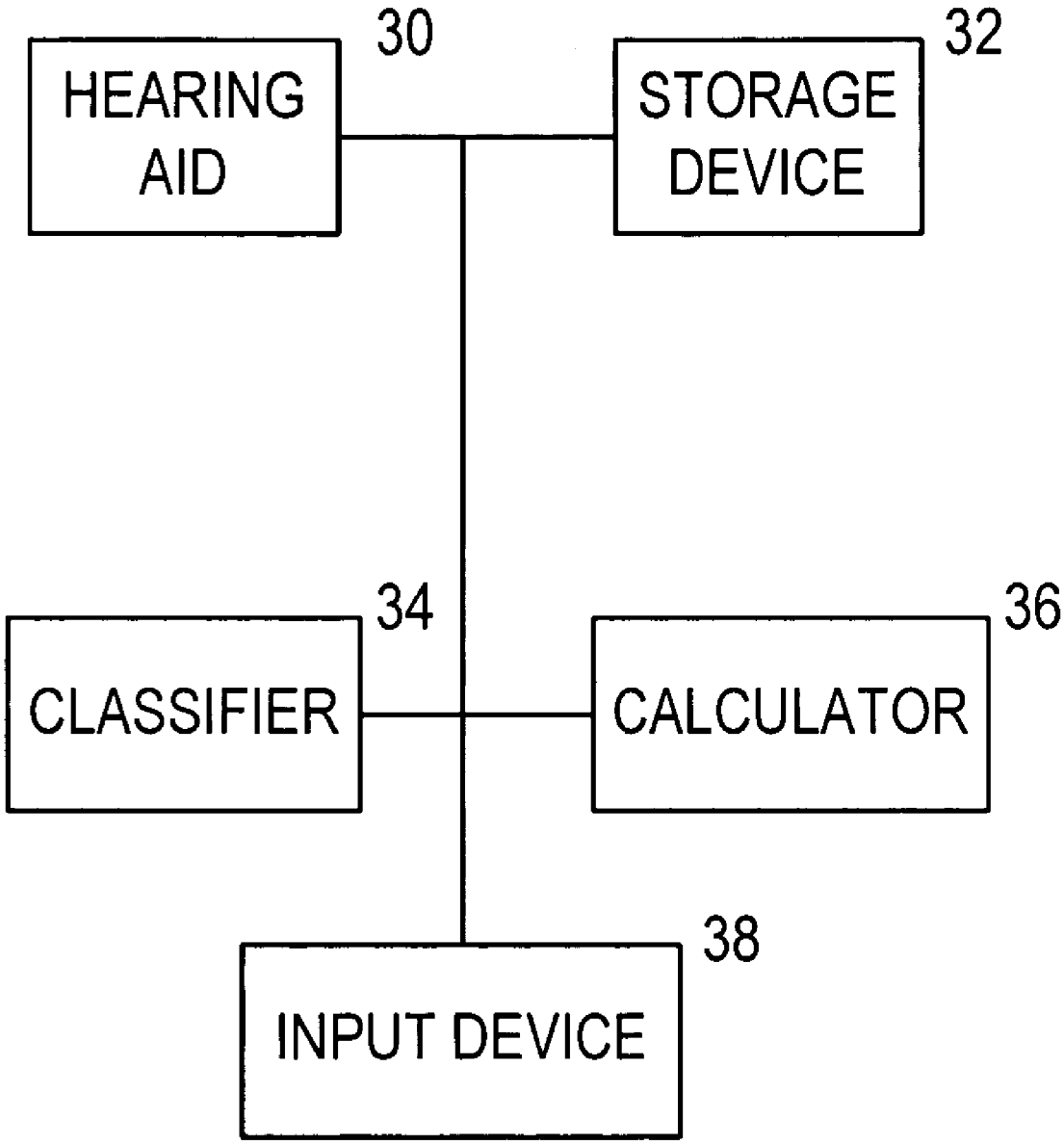
FIG. 3 is a block diagram showing an embodiment of the inventive system.

A plurality of setting configurations are initially provided to the auditory system 20 (FIG. 2) The user or, respectively, hearing device user starts the interactive adaptation event, for example by pressing a corresponding button on the hearing device 30 (FIG. 3) or on a remote control. This can occur in any arbitrary auditory situation. The automatic situation recognition first analyzes and classifies (classifier 34) the present auditory situation 22. Alternative parameter configurations are determined (for example, by way of a simplex method) from the setting of the hearing device stored for this situation.

In addition to the current setting configuration or, respectively, parameter configuration, the hearing device user is offered a further setting configuration (characteristic curve 3) dependent on the classified situation 24. This ensues, for example, in that the hearing device user switches back and forth between two settings or, respectively, programs. This switching can also ensue automatically within a set time interval. The hearing device user selects the preferred setting, for example by pressing a key provided for this 26. The system hereupon calculates (with the calculator 36) the next setting configuration, which the hearing device user can again adjust before the selection. The optimization event automatically stops after fulfillment of a defined stop criterion, or can be stopped as desired by the hearing device user. The optimization event can be restarted at any time.

The system stores (storage device 32) the optimal setting with regard to the respective auditory situation and recalls it again automatically when the user is located in a likewise classified situation. In the event that the user is located in a situation that is not recognized by the classification system, an average setting configuration can, for example, be selected as a hearing device setting that is comprised of average values of the individual parameters over the presently existing settings.

In an embodiment of the invention, the interactive adaptation can also ensue over an arbitrarily long span of time in which no relative comparisons are undertaken between two or more setting configurations, but rather the interaction ensues via a spontaneous, absolute evaluation of the current setting by the user. Such an absolute evaluation can ensue in a binary manner via, for example, "good/bad" or, also via a multi-stage mark scale. For this, the evaluation can, for example, be input by way of a remote control, a special code of the operating elements of the auditory system, or per speech input in the auditory system.

In a special embodiment, the situation recognition (meaning the classification) is implemented in a remote control that moreover possesses a control unit for the setting optimization. The hearing device parameters or, respectively, setting configurations are calculated by the remote control and transferred to the hearing device.

The hearing device user is therewith in the position to test and, as needed, to readjust a hearing device in everyday life with the first setting provided by the hearing device acoustician. It is thus no longer necessary that the hearing device user seeks a specialist or, respectively, hearing device acoustician for readjustment. The optimization event is also clearly improved, in that the respective optimization occurs in a real everyday situation and not in an approximate manner, under laboratory conditions.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

| REFERENCE LIST | |
|---|---|
| 1 | current amplification characteristic curve |
| 2 | optimal characteristic curve |
| 3 | first new characteristic curve |
| 4 | second new characteristic curve |
| V | Amplification |
| f | Frequency |
| 20-26 | method steps |
| 30 | hearing aid |
| 32 | storage device |
| 34 | classifier |
| 36 | calculator |
| 38 | input device |

What is claimed is:

1. A method to adjust an auditory system having at least one hearing aid, comprising:

providing a plurality of setting configurations in the auditory system;

automatically classifying a current auditory situation;

offering of a group of setting configurations (3, 4) from the plurality of setting configurations, dependent on the classified auditory situation; and interactively selecting, with the auditory system, a setting configuration from the group of setting configurations.

2. The method according to claim 1, wherein the interactive selection ensues by operating one or more operating elements at the hearing aid.

3. The method according to claim 1, wherein the interactive selection ensues by operating a remote control.

4. The method according to claim 1, wherein the interactive selection ensues by speaking via a speech input.

5. The method according to claim 1, wherein all method steps are implemented at least one of a) in and b) on the hearing aid.

6. The method according to claim 1, wherein the group of setting configurations are determined via a simplex method.

7. The method according to claim 1, wherein the plurality of setting configurations concern a binaural auditory system.

8. An auditory system, comprising:

at least one hearing aid;

a storage device configured to provide plurality of setting configurations;

a classifier configured to automatically classify an auditory situation;

a calculator device configured to automatically select a group of setting configurations dependent on the classified auditory situation; and an input device configured for an interactive selection of a setting configuration from the group of setting configurations.

9. The auditory system according to claim 8, wherein the input device comprises one or more operating elements of the at least one hearing aid.

10. The auditory system according to claim 8, wherein the input device comprises a remote control.

11. The auditory system according to claim 8, wherein the input device comprises a speech input unit.

12. The auditory system according to claim 8, wherein the storage device, the classification device, the calculation device and the input device are housed in the at least one hearing aid.

13. The auditory system according to claim 8, wherein the group of setting configurations are determined in the calculation device via a simplex method.

14. The auditory system according to claim 8, wherein the setting configurations concern a binaural auditory system.

* * * * *